United States Patent [19]

Golder

[11] Patent Number: 4,569,565

[45] Date of Patent: Feb. 11, 1986

[54] BLIND-MATING, POSITIONALLY ADJUSTABLE ELECTRICAL CONNECTION DEVICE

[75] Inventor: Louis Golder, Fairfax, Va.

[73] Assignee: The United States of America as represented by the Secretary of the Air Force, Washington, D.C.

[21] Appl. No.: 515,834

[22] Filed: Jul. 21, 1983

[51] Int. Cl.[4] ..... H01R 21/28

[52] U.S. Cl. ..... 339/64 R

[58] Field of Search ..... 339/64 R, 64 M

[56] References Cited

U.S. PATENT DOCUMENTS

| | | | |
|---|---|---|---|
| 1,418,171 | 5/1922 | Raettig | 339/64 R |
| 1,864,283 | 3/1929 | Steinmayer | 339/64 R |
| 2,222,252 | 11/1940 | Cochran et al. | 339/64 M |
| 2,681,441 | 5/1952 | Linn | 339/259 |
| 2,882,510 | 4/1959 | Colvin | 339/64 R |
| 2,988,414 | 11/1959 | Crowe et al. | 312/326 |
| 2,993,187 | 7/1961 | Bisbing et al. | 339/64 M |
| 3,178,538 | 4/1965 | Kradel et al. | 339/64 R |

FOREIGN PATENT DOCUMENTS

| | | | |
|---|---|---|---|
| 2548692 | 5/1977 | Fed. Rep. of Germany | 339/64 R |
| 2907039 | 8/1980 | Fed. Rep. of Germany | 339/64 R |

*Primary Examiner*—Gil Weidenfeld
*Assistant Examiner*—Gary F. Paumen
*Attorney, Agent, or Firm*—Donald J. Singer; Jacob N. Erlich

[57] ABSTRACT

A blind-mating, positionally adjustable electrical connector device of the plug-and-socket type, with the plug connected to an electrically conductive structure (such as a passive printed circuit board), and with the electrified socket insulatively attached in a positionally adjustable manner to a base member (such as a chasis). Unlike the prior art, the positionally adjustable socket can be moved to correct a misalignment with the plug thereby permitting easy blind-mating of the plug and the socket, and the socket can be quickly de-electrified by a quick disconnect means which includes a wire lead, from an electric source, removably wrapped around a terminal in electrical connection with the socket, with the wire lead easily and quickly unwrapable from the terminal.

6 Claims, 2 Drawing Figures

BLIND-MATING, POSITIONALLY ADJUSTABLE ELECTRICAL CONNECTION DEVICE

STATEMENT OF GOVERNMENT INTEREST

The invention described herein may be manufactured and used by or for the Government for governmental purposes without the payment of any royalty thereon.

BACKGROUND OF THE INVENTION

This invention relates generally to electrical connectors and more particularly to a unique blind-mating, positionally adjustable electrical connection device.

Although electrical connection devices of the type which include an open ended electrically conductive socket into which a mating conductive plug is to be inserted are well known in the art, and although blind-mating per se is equally well known, what is new is that, with the advent of printed circuit boards and their many applications, a number of problems have arisen in the art if a printed circuit board of the passive type is to be blind-mated to a chasis, frame, deck or the like with a plug or socket connection.

These problems include, but are not limited to, the following described ones. In prior art devices the plug and socket alignment is so narrow in latitude (e.g., 0.015 of an inch), that any misalignment beyond that narrow latitude effectively prevents mating. In addition, prior art electrical connectors are much larger in size and/or have greater bulk than desired and/or needed. Further, the hardware use in these prior art electrical connectors is expensive, and it is difficult at times to obtain because it is not common. Also, these prior art devices do not provide any quick disconnect feature after mating, but rather require the unsoldering of an electric lead to the connector; and, in some cases, the removal of a cover of the printed circuit board device is necessary before attaining access to the lead which is then to be unsoldered.

Accordingly, it is fair and accurate to say that what is needed in the art, and is not presently available, is an electrical connector device which permits blind-mating within a wide latitude (e.g., 0.062 to 0.1 of an inch) of misalignment of the plug and socket; which allows a quick electrical disconnect, as desired, after blind-mating without having to unsolder any electric lead; which is compact in size; and which uses, as constituent components, inexpensive common hardware.

SUMMARY OF THE INVENTION

The instant invention satisfies the above-mentioned need; and, therefore, constitutes a significant advance in the state of the art.

In accordance with the instant invention, a plug member of the inventive electrical connector device is mechanically and electrically connected to a passive (i.e., non-electrified) printed circuit board (or other electrically conductive structure) which is to be electrically energized by being releasably blind-mated to an electricity conducting complementary socket member into which the plug member is to be inserted and with which it is to be mated. The plug member, which has a pin end portion for insertion into the socket member, is preferably connected to the edge of the printed circuit member. The socket member and an electrically conducting terminal member are mounted on, and are in electrical connection with, a strip-like electrically conductive member (such as a metal shim) which, in turn, is mounted on a dielectric plate-like member that has an opening through it. This plate-like member is adjustably positioned in a recess or opening in the upper surface of a preselected base member (such as a chasis, a frame, a deck, or the like) which preferably also has another opening (i.e., a counter bore) in the lower surface and an oversized passageway or hole interconnecting the recess and the counter bore. A bolt and nut fastener is used to releasably attach the dielectric plate-like member to the base member, after the hole through the plate-like member and the passageway or hole in the base member are aligned, and the bolt shank is passed through the aligned holes, with the bolt head being in the counter bore. The fastener is tightened with the nut after the position of the dielectric member is adjusted and after the user has ascertained that the plug member number attached to the printed circuit board and the socket are in alignment and mateable. The electrically conductive terminal member is then connected by a suitable means (such as an electrically conductive wire lead) to a source of electricity. Thereafter, the pin-ended plug member with its printed circuit board, and the socket with its base member are easily blind-mated, and when desired can be quickly disconnected.

Accordingly, it is an object of the instant invention to provide a unique electrical connector device of the plug-and-socket type that will permit the easy blind-mating of an electrically conductive structure, such as a passive printed circuit board, to a source of electricity.

It is another object of this invention to provide an electrical connector device as set forth hereinabove that will allow a wide latitude in misalignment of the plug member attached to the printed circuit board and the socket member attached to the chasis, and nevertheless will still permit easy blind-mating.

It is still another object of the instant invention to provide an electrical connector device as described hereinabove which, in addition to permitting easy blind-mating, will also permit a quick disconnect, when desired, before or after blind-mating.

It is yet another object of this invention to provide the hereinbefore described electrical connection device that is compact in size; and, therefore, is useable where the bulky prior art connectors are not.

It is a further object of the instant invention to provide the foregoing described electrical connection device which uses, and can be inexpensively manufactured with, common, readily-available, low-priced constituent components.

These objects of this invention, as well as other objects related thereto (such as simplicity in structure, reliability, and the like), will become readily apparent after a consideration of the description of the instant invention, coupled with reference to the contents of the Figures of the drawing.

It is here to be noted that the representative dimensions shown in the Figures are for illustrative purposes only, so that the reader will be aware of the compactness of the instant invention.

DESCRIPTION OF THE PREFERRED EMBODIMENT AND VARIATION

Figure 1:
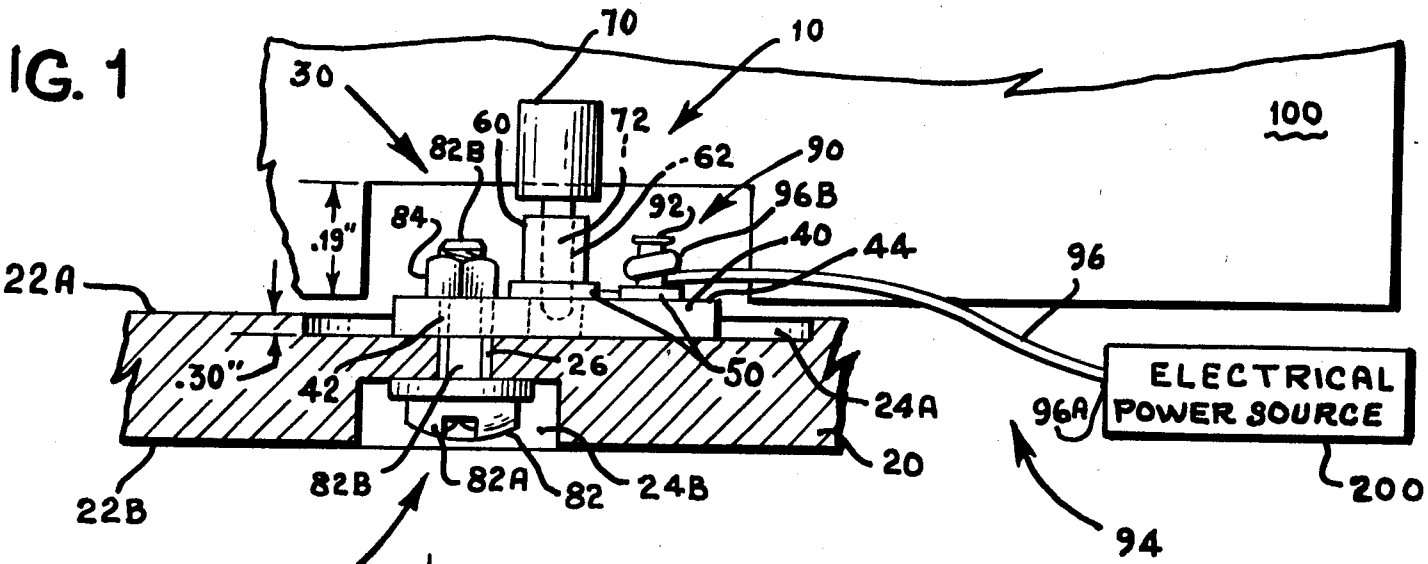
FIG. 1 is a side elevation view, in simplified pictorial and schematic form, partially in cross section and partially fragmented, and enlarged and in detail, of a preferred embodiment of the instant invention in use.
Figure 2:
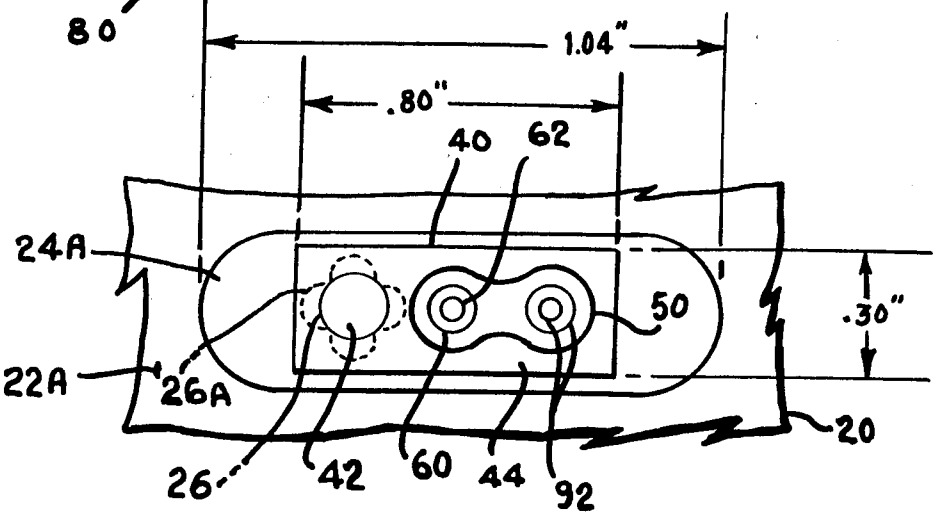
FIG. 2 is a top view, in simplified pictorial and schematic form and partially fragmented, of a portion of the preferred embodiment shown in FIG. 1, and of a variation thereof shown in phantom.

As a preliminary matter, and with reference to FIGS. 1 and 2, it is to be remembered that the instant invention is for use with an electrically conductive structure 100, FIG. 1, such as a passive printed circuit board.

In the most basic and generic structural form, and using sementically oversimplified language, the preferred embodiment 10, FIGS. 1 and 2, of the instant invention comprises: a base member 20 (such as a chasis, a frame, a deck, or the like); means (generally designated 30), interposed between and operably associated with the base member 20 and the electrically conductive structure 100 (e.g., the passive printed circuit board), for releasably blind-mating the electrically conductive structure 100 to the base member 20, wherein this means 30 includes a socket member 60 mounted on the base member 20, and a complementary plug member 70 attached to the electrically conductive structure 100; and, means (generally designated 90), in selective mechanical and electrical connection with a strip-like electrically conductive member 50 of blind-mating means 30 (to which said strip-like member 50 is electrically connected the socket member 60), for permitting either the quick connection and electrification of the strip-like member 50 and therefore of the socket member 60, or the quick disconnection and de-electrification of the strip-like member 50 and therefore of the socket member 60.

More specifically, the base member 20 is disposed adjacent the electrically conductive structure 100 (i.e., the passive printed circuit board) which is to be blind-mated. Said base member 20 has an upper surface 22A with a first opening or recess 24A in it; a lower surface 22B with a second opening or counter bore 24B in it; and a passageway or hole 26 in communication with the two openings 24A and 24B. As is shown in FIG. 1, the passageway or hole 26 is oversized and is vertically perpendicular to the horizontally parallel-spaced surfaces 22A and 22B and to the respective openings 24A and 24B therein. As a matter of preference, the base member 20 is made of metal, but it can be made of any material which is desired or needed for the application intended.

Also more specifically, the means 30 (which is interposed between and operably associated with the base member 20 and the electrically conductive structure 100) for releasably blind-mating the electrically conductive structure 100 to the base member 20, includes, in combination, an insulating plate-like member 40, an electrically conductive strip-like member 50, an electrically conductive socket member 60, an electrically conductive plug member 70, and means (generally designated 80) for releasably connecting the plate-like member 40 to the base member 20 and for permitting a correction of a linear misalignment (if any) of the plug member 70 and of the socket member 60.

The plate-like member 40 is made of any suitable dielectric material (such as glass or ceramic material) and has a hole 42 through it. This plate-like member 40 is disposed within, and is in contact with, the first opening or recess 24A in the upper surface 22A of the base member 20, such that the hole 42 and the passageway or hole 26 in the base member 20 are in communication, and also such that the plate-like member 40 is positionally adjustable (e.g., is slidably movable) within the opening or recess 24A. After the correct or desired position of the plate-like member 40 is determined (as will be explained later herein), a screw or the like (not shown in the interest of maintaining the simplicity of the Figures of the drawing) is used to "tie down" the plate-like member 40 to the floor of the opening or recess 24A. As a matter of preference, the hole 42 through the plate-like member 40 is vertically perpendicular.

The strip-like member 50 is made of any suitable electrically conductive material (such as metal) and is mounted on, and is in contact with, the upper surface 44 of the dielectric plate-like member 40.

The electrically conductive socket member 60 is mounted on, and is in electrical connection with, the strip-like electrically conductive member 50.

The electrically conductive plug member 70 is complementary to, and removably insertable into and mateable with, the electrically conductive socket member 60, with this plug member 70 being in electrical connection with the electrically conductive structure 100.

It is here to be noted that the plug member 70 has a pin end portion 72 and that the socket member 60 has a corresponding lead in portion 62 to accept the pin end portion 72 of the plug member 70.

The means 80 for releasably connecting the insulating plate-like member 40 to the base member 20 through the passageway or hole 26 in the base member 20 and through the hole 42 in the plate-like member 40, and for permitting the correction of a linear misalignment (if any) of the plug member 70 and of the socket member 60, is operably associated with the base member 20 and the plate-like member 40. This means 80 includes: a bolt member 82 having a head portion 82A in the second opening or counter bore 24B in the lower surface 22B of the base member 20, and a shank portion 82B passing through the passageway or oversized hole 26 in the base member 20 and also through the hole 42 in the dielectric plate-like member 40; and, a nut member 82 engaged to the bolt shank portion 82B that extends out of the hole 42.

Further more specifically, the aforementioned means 90, (which is selectively mechanically and electrically connected to the strip-like electrically conductive member 50 of the blind-mating means 30) for permitting either the quick connection and electrification of the strip-like member 50 and therefore of the socket member 60, or the quick disconnection and de-electrification of the strip-like member 50 and therefore of the socket member 60, includes: an electrically conductive terminal member 92 in electrical connection with the conductive strip-like member 50; and means (generally designated 94) for selectively conducting electricity from a source of electricity (such as electric source 200, FIG. 1) to the terminal member 92. As a matter of preference, this electricity conducting means 94 includes an electrically conductive wire lead (such as 96, FIG. 1) having one end 96A in electrical connection with the source of electricity 200, and with the other end 96B wrapped around and in electrical connection with the terminal member 92. As a result of this connection, the conductive terminal member 92, the conductive strip-like member 50, and the socket member 60 are electrified. Likewise, since the wrapped around end 96B can be easily unwound (such as with an insulated screw driver that is not shown), the quick disconnection of this lead 96B from the terminal member 92 can be quickly accomplished and the de-electrification of the terminal member 92, of the strip-like member 50, and the socket member 60 thereby results.

With reference to FIG. 2 only, therein is shown not only a portion of the preferred embodiment shown in FIG. 1, but also a variation thereof in phantom. Said variation comprises a cruciform shaped (or cruciform-like shaped) passageway 26A in said base member 20, whereby the bolt shaft portion 82B of the bolt member 82 can be positioned through any portion of the cruciform shaped passageway 26A to adjust the position of the insulating plate-like member 40 (and, thus, adjust the position of the socket member 60 which is mounted on the strip-like member 50 which, in turn, is mounted on the plate-like member 40) to correct a misalignment of the socket member 60 and of the plug member 70, and thereby permit alignment and easy blind-mating of said plug and socket members.

MANNER OF USE OF THE PREFERRED EMBODIMENT AND VARIATION

The manner of use, and of operation, of the preferred embodiment 10 (and of the variation thereof) of the instant invention can be easily ascertained by any person of ordinary skill in the art from the foregoing description, coupled with reference to the contents of the Figures of the drawing.

For those not of the art, the manner of use and operation of the instant invention can be learned by correlating the contents of the Figures of drawing with the description of the invention, especially that portion thereof entitled "Summary of the Invention." For all, it is important to note that the amount of misalignment that can be corrected by the use of this invention, is preselected by configuration and size of the hole 26 in base member 20, by the size and extent of the counter bore 24B in the base member 20, and by the sizing and positioning of the socket member 60.

CONCLUSION

It is abundantly clear from all of the foregoing, and from the contents of the Figures of the drawing, that the stated objects of the instant invention, as well as other objects related thereto, have been achieved.

It is to be noted that, although there have been described and shown the fundamental and unique features of the instant invention as applied to a preferred embodiment 10 and a variation thereof, nevertheless various other embodiments, variations, adaptations, substitutions, additions, omissions, and the like may occur to and can be made by those of ordinary skill in the art. For example: a plurality of the inventive electrical connection devices 10 can be adapted for use with, and can be used with, a single printed circuit board or other electrically conductive structure; and, the inventive electrical connection device may be adapted for use with, and can be used with an active (i.e., electrified) printed circuit board or the like; and also the nut member may be integrated with the dielectric plate-like member.

What is claimed is:

1. A blind-mating, positonally adjustable electrical connection device for use in releasably blind-mating an electrically conductive structure to a source of electricity, said electrical connection device comprising:

a. a base member disposed adjacent said electrically conductive structure which is to be blind-mated thereto, with said base member having an upper surface with a first opening therein, and a passageway in said base member essentially in the shape of a cruciform of predetermined size on communication with said opening;

b. means, interposed between and operably associated with said base member and said electrically conductive structure, for releasably blind-mating said electrically condutive structure to said base member, wherein this means includes:

a plate-like member made of dielectric material and having a hole therethrough of predetermined size, with this member disposed within and in contact with said first opening in said upper surface of said base member, such that said hole in said plate-like member and said cruciform-shaped passageway in said base member are in communication, and also such that said plate-like member is positionally adjustable within said first opening in said base member;

a strip-like member made of electrically conductive material and mounted on and in contact with an upper surface of said plate-like member;

an electrically conductive socket member mounted on, and in electrical connection with, said strip-like electrically conductive member;

an electrically conductive plug member complementary to, and removably insertable into and matable with, said electrically conductive socket member, wherein said plug member is in electrical connection with said electrically conductive structure; and means for releasably connecting said plate-like member to said base member and for permitting a correction of a linear misalignment of said plug member and of said socket member, wherein said releasably connecting means includes a bolt member having a shank portion of a predetermined size passing through said cruciform-shaped passageway in said base member and through said hole in said plate-like member and extending out of said hole, wherein said predetermined size of said shank portion is less than said predetermined size of said hole and less than said predetermined size of said cruciform-shaped passageway, and a nut member engaged to said bolt shank portion extending out said hole, wherein said bolt shaft portion of said bolt member can be positioned through any portion of said cruciform-shaped passageway, whereby the position of said plate-like member and thus the position of said socket member can be adjusted with respect to said electrically conductive structure and thereby correct a misalignment of said socket member and of said plug member, and also thereby permit alignment and easy blind-mating of said plug and socket members; and c. means, in selective mechanical and electrical connection with said strip-like electrically conductive member of said means for releasably blind-mating said electrically conductive structure to said base member, for permitting either quick connection to and electrification of said strip-like member, of quick disconnection of and de-electrification of said strip-like member wherein said means for permitting quick connection or disconnection includes a electrically conductive terminal member in electrical connection with said strip-like member, and means for selectively conducting electricity from a source of electricity to said terminal member.

2. A blind-mating, positionally adjustable electrical connection device, as set forth in claim 1, wherein said plug member has a pin end portion and said socket member has a corresponding lead in portion of said pin end portion.

3. A blind-mating, positionally adjustable electrical connection device, as set forth in claim 2, wherein said base member has a lower surface with a second opening therein in communication with said base member passageway, and wherein said bolt member has a head portion, and also wherein said means for releasably connecting said plate-like member to said base member for permitting a correction of a misalignment of said plug member and of said socket member further includes said bolt head portion positioned in said second opening in said lower surface of said base member.

4. A blind-mating, positionally adjustable electrical connection device, as set forth in claim 3, wherein said means for selectively conducting electricity from a source of electricity to said electrically conductive terminal member includes an electrically conductive wire lead with one end in electrical connection with a source of electricity and with another end wrapped around and in electrical connection with said terminal member, whereby said wrapped around end of said wire lead can be easily unwound, and thereby the quick disconnection of said lead from said terminal member can be accomplished.

5. A blind-mating, positionally adjustable electrical connection device, as set forth in claim 4, wherein said electrically conductive structure is a printed circuit board, and wherein said base member is a chassis.

6. A blind-mating, positionally adjustable electrical connection device, as set forth in claim 5, wherein said plate-like member is positionally adjustable within said first opening in said base member over a range of 0.062–0.1 inches.

* * * * *